US005262791A

United States Patent [19]

Tsuda et al.

[11] Patent Number: 5,262,791

[45] Date of Patent: Nov. 16, 1993

[54] MULTI-LAYER ARRAY ANTENNA

[75] Inventors: Yoshiaki Tsuda; Masato Inoue; Nobutake Orime; Takashi Katagi, all of Kanagawa, Japan

[73] Assignee: Mitsubishi Denki Kabushiki Kaisha, Tokyo, Japan

[21] Appl. No.: 940,081

[22] Filed: Sep. 3, 1992

[30] Foreign Application Priority Data

Sep. 11, 1991 [JP] Japan ..... 3-231793

[51] Int. Cl.[5] ..... H01Q 1/38

[52] U.S. Cl. ..... 343/700 MS; 343/725; 343/770

[58] Field of Search ..... 343/700 MS, 767, 770, 343/725, 846

[56] References Cited

U.S. PATENT DOCUMENTS

| | | | |
|---|---|---|---|
| 4,926,189 | 5/1990 | Zaghloul et al. | 343/700 MS |
| 5,124,733 | 6/1992 | Haneishi | 343/700 MS |
| 5,153,600 | 10/1992 | Metzler et al. | 343/700 MS |

OTHER PUBLICATIONS

"Characteristics of a Two-Layer Microstrip Antenna for Dual Frequency Use", Y. Tsuda, M. Inoue, N. Orime, T. Katagi, 1991 Spring National Convention Record, The Institute of Electronics, Information and Communication Engineers, Mar. 26-28, 1991, Japan.

"Dual Frequency Band Circularly Polarized Microstrip Antenna", S. Uchino, Y. Naito, K., Kanazawa, 1991 Spring National Convention Record.

"Design of a Two-Layer, Capacitively Coupled, Microstrip Patch Antenna Element for Broadband Applications", R. T. Cock, C. G. Christodoulou, Antennas and Propagation vol. II, Jun. 15-19, 1987.

*Primary Examiner*—Donald T. Hajec
*Assistant Examiner*—Tan Ho
*Attorney, Agent, or Firm*—Wolf, Greenfield & Sacks

[57] ABSTRACT

A multi-layer array antenna having high frequency band microstrip antennas formed on a surface of a first dielectric substrate, comb-shaped low frequency band microstrip antennas formed on a surface of a second dielectric substrate which is disposed on the first dielectric substrate, and through-holes for supplying microwave power to the comb-shaped low frequency band microstrip antennas through the first and the second dielectric substrates.

24 Claims, 13 Drawing Sheets

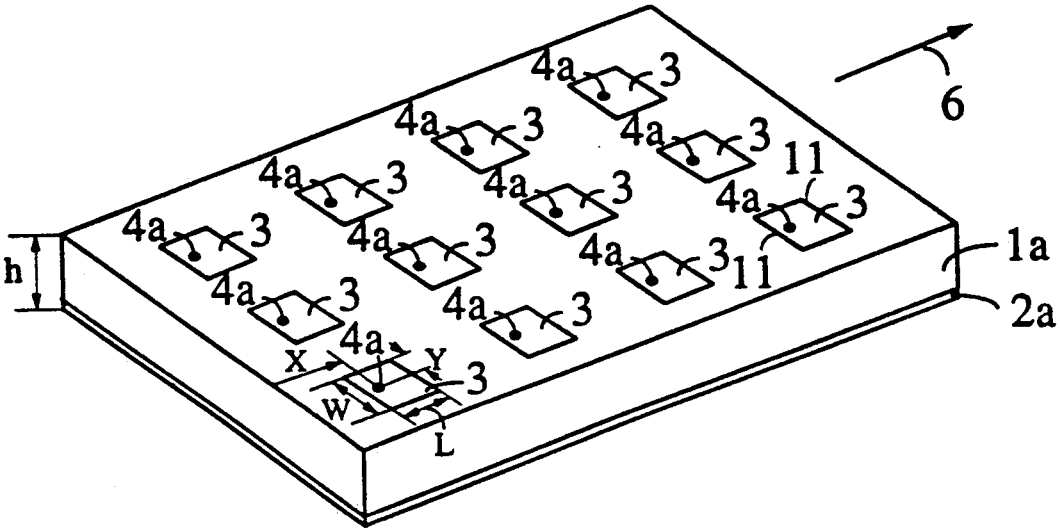
Fig. 12 (a) PRIOR ART
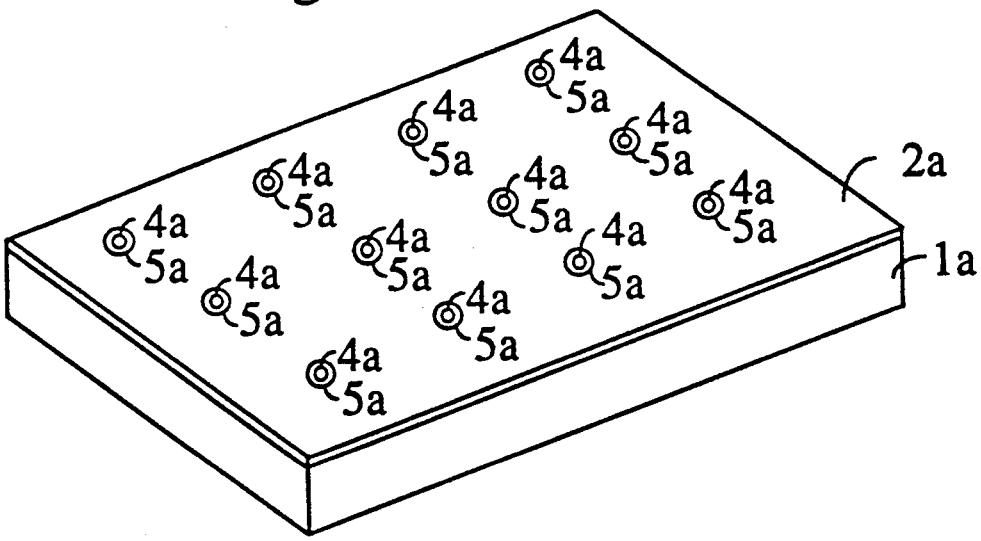
Fig. 12 (b) PRIOR ART

MULTI-LAYER ARRAY ANTENNA

BACKGROUND OF THE INVENTION

The invention relates to an array antenna using microstrip antenna used for two frequencies and inhibitive blocking.

A microstrip antenna using an unbalanced planar circuit generally has the advantage of small size light weight and low loss.

FIG. 12 is a perspective view of the conventional microstrip antenna described in the book, I.J. Bahl, P. Bhartia, "Microstrip antennas" second chapter, p. 31–84, 1980, ARTECH HOUSE, INC. FIG. 12(*a*) is a perspective view of the conventional microstrip antenna as viewed from the top face. FIG. 12(*b*) is a perspective view of the conventional microstrip antenna as viewed from the bottom face. In the figure, 1*a* is a dielectric substrate. 2*a* is an earth conductor formed on one side of the dielectric substrate 1*a*. 3 are rectangular radiating conductors having edges L and W formed on another side of the dielectric substrate 1*a*. 4*a* are power supplying through holes for supplying microwave energy to the rectangular radiating conductors 3. 5*a* are clearances for causing the power supplying through holes 4*a* to cut off the direct current from the earth conductor 2*a*. 11 are open edges of the radiating conductors which radiate the high frequency band microwave therefrom. 6 is a polarization direction of the main polarized wave radiated from the array antenna.

The operation of the conventional array antenna is explained using FIG. 12(*a*) and FIG. 12(*b*). The microwave energy supplied to the plurality of rectangular radiating conductors 3 through the plurality of power supplying through-hole 4*a*, have current components being parallel to the polarized direction 6 and magnetic current components being orthogonal to the polarized direction 6. An electromagnetic wave is radiated from the rectangular radiating conductors 3 to the space by the current sources and the magnetic current sources which are formed by the current components and the magnetic current components, respectively. The electric field direction of the radiated electromagnetic wave is the same as the polarized direction 6.

The resonance frequency f0 of the fundamental mode of the microstrip antenna is mainly determined by the edge length L of the rectangular radial conductors 3 and the relative dielectric constant $\epsilon r$ of the dielectric substrate 1*a*. The frequency band width is also determined by the relative dielectric constant $\epsilon r$ and the thickness h of the dielectric substrate 1*a*. The frequency band width is wider if the relative dielectric constant $\epsilon r$ is smaller and the thickness h is larger. But the selection range of the thickness h is limited in order to suppress the higher mode excitation. The frequency band width of the practical microstrip antenna is about several percents as shown in FIG. 13. FIG. 13 shows the relation between resonance frequency and reflection characteristics of the microstrip antenna used as the conventional array antenna.

An impedance at the power supply points of the power supplying through holes 4*a* form where the microwave supplied to the microstrip antennas becomes high when the power supplying through-holes 4*a* are adjacent at the position of the open border edges so that the distance X equals 0. The impedance at the power supply points becomes lower when the power supplying through-holes 4*a* reach a center of the radiating conductors 3. Therefore, the impedance at the power supply points can be matched with an impedance of a feeding circuit by selecting the distance X.

The dimension Y of the microstrip antenna is selected such as $Y=W/2$ in order to avoid the generation of the cross polarized wave component.

Since the conventional array antenna is constructed as described above, there are some problems that an array antenna can be used only in a single frequency band when used for a radar antenna, and a plurality of targets cannot be processed at the same time in case where there are more than two targets within the beam search range of the radar.

It is a primary object of the present invention to provide an array antenna which can be used in two frequency bands.

It is another object of the present invention to provide an array antenna which radiates an electromagnetic wave from high frequency band microstrip antenna through the comb-shaped gap of the low frequency band microstrip antennas without receiving the influence of blocking by the comb-shaped low frequency band microstrip antenna.

It is a further object of the present invention to provide an array antenna which improves the angular resolution by diminishing the beam width of the antenna radiation pattern, by changing the operating frequency from lower frequency to higher frequency, when the array antenna is used as a radar antenna.

SUMMARY OF THE INVENTION

According to one aspect of the present invention, there is provided a multi-layer array antenna comprised of a plurality of radiating conductors on one surface of a dielectric substrate, an earth conductor on another surface of the dielectric substrate, through holes for supplying microwave energy to the radiating conductors and clearances for insulating direct current between the through-holes and the earth conductor. The antenna comprises; high frequency band radiating conductors formed on a surface of a first dielectric substrate; comb-shaped low frequency band radiating conductors formed on a surface of a second dielectric substrate which is disposed on the first dielectric substrate; and through-holes for supplying microwave power to the comb-shaped low frequency band radiating conductors through the first and the second dielectric substrates.

According to one aspect of the present invention, there is provided a multi layer array antenna comprised of a plurality of radiating conductors on one surface of a dielectric substrate, an earth conductor on another surface of the dielectric substrate, through holes for supplying microwave energy to the radiating conductors and clearances for insulating direct current between the through-holes and the earth conductor. The antenna comprising; high frequency band slot elements formed through a second dielectric substrate which is disposed on the first dielectric substrate; comb-shaped low frequency band radiating conductors formed on a surface of a third dielectric substrate which is disposed on the second dielectric substrate; and through-holes for supplying microwave power to the comb-shaped low frequency band radiating conductors through the first, second and third dielectric substrates.

BRIEF DESCRIPTION OF THE DRAWING

FIGS. 5*a*, 5*b*, 3*c* show three kinds of arrangements in case the low frequency band radiating conductor 7*a* has a comb-shape only at one side of it on the upper layer.

FIGS. 7*a*, 7*b*, and 3*c* show three kinds of arrangements in case the low frequency band radiating conductor 7 has a comb-shape at both sides of it on the upper layer.

FIGS. 12*a* and 12*b* are perspective view of the conventional radiating conductor.

DETAILED DESCRIPTION OF THE PREFERRED EMBODIMENTS

First Embodiment

Figure 1:
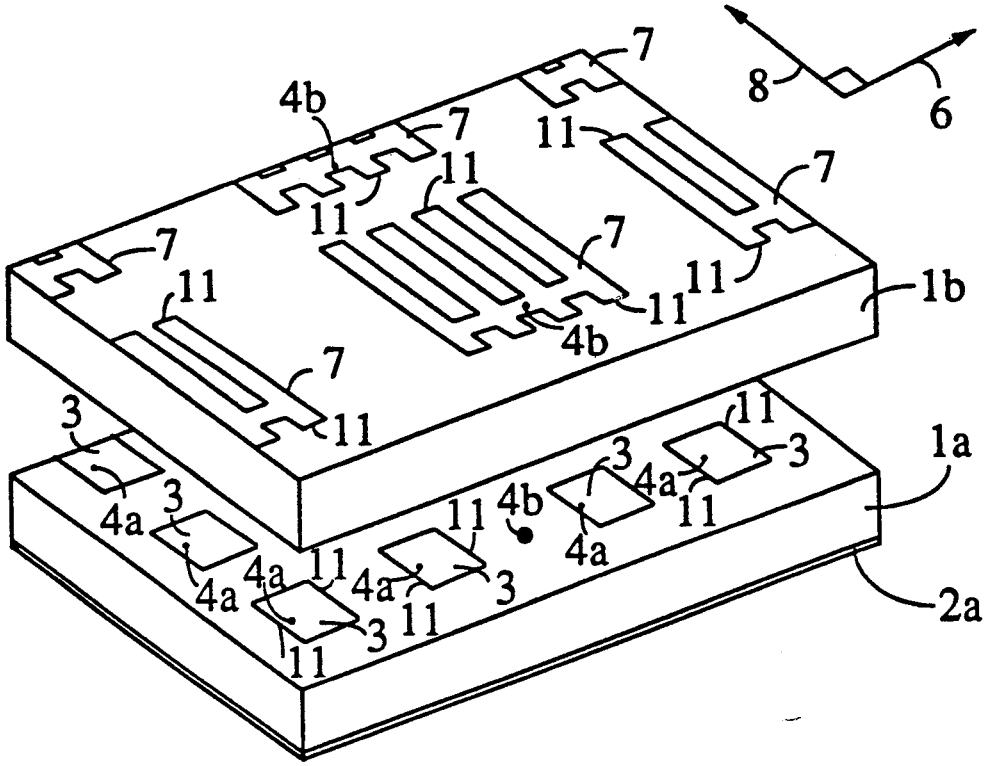
FIGS. 1*a* and 1*b* are perspective view of a part of a multi layer array antenna of a first embodiment of the present invention.
Figure 1:
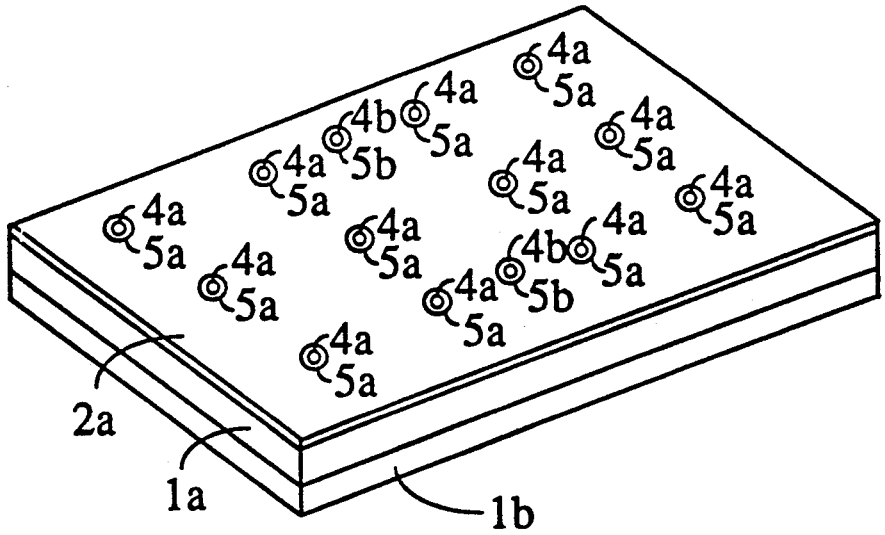

FIGS. 1*a* and 1*b* are perspective view of a part of a multi layer array antenna of a first embodiment of the present invention. FIG. 1(*a*) is a perspective view of the multi layer array antenna as viewed from the top face. FIG. 1(*b*) is a perspective view of the multi layer array antenna as viewed from the bottom face. In the figure, 1*a*, 2*a* and 5*a* are the same portions of the array antenna as that of FIG. 12*a*. 3 is a high frequency band radiating conductor which is connected with the power supplying through-hole 4*a*. 6 is a main polarization direction of the high frequency band which indicates a direction of an electrical field vector radiated from the high frequency band microstrip antenna. 7 is a comb-shaped low frequency band radiating conductor connected with power supplying through-hole 4*b*. 8 is a main polarization direction of the low frequency band which indicates a direction of an electrical field vector radiated from the comb-shaped low frequency band microstrip antenna.

The operation of the first embodiment is explained here. In the explanation, the operating frequency is referred to two frequency bands, a low frequency band and a high frequency band.

The operation of the array antenna at the low frequency band is explained here. For example, when the X band microwave inputs into the power supplying through-hole 4*b* on the earth conductor 2*a*, and is supplied to the comb-shaped low frequency band radiating conductor 7 on the dielectric substrate 1*b* through the dielectric substrate 1*a*, a current component being parallel to the low frequency band polarization direction 8 or a magnetic current component orthogonal to the low frequency band polarization direction 8 are generated on the comb-shaped low frequency band radiating conductor 7 or thereabout. An electromagnetic wave is radiated from the comb-shaped low frequency band microstrip antenna to space by the current sources and the magnetic current sources which are formed by the current components and the magnetic current components, respectively. The electric field direction of the radiated electromagnetic wave is the same a the low frequency band polarization direction 8. Since the X band region of the electromagnetic wave radiated from the current source or the magnetic current source is far apart from the resonance frequency of the high frequency band microstrip antenna, and since the low frequency band polarization direction 8 is perpendicular to the high frequency band polarization direction 6, the X band electromagnetic wave is hardly influenced by the high frequency band radiating conductor 3.

Figure 2:
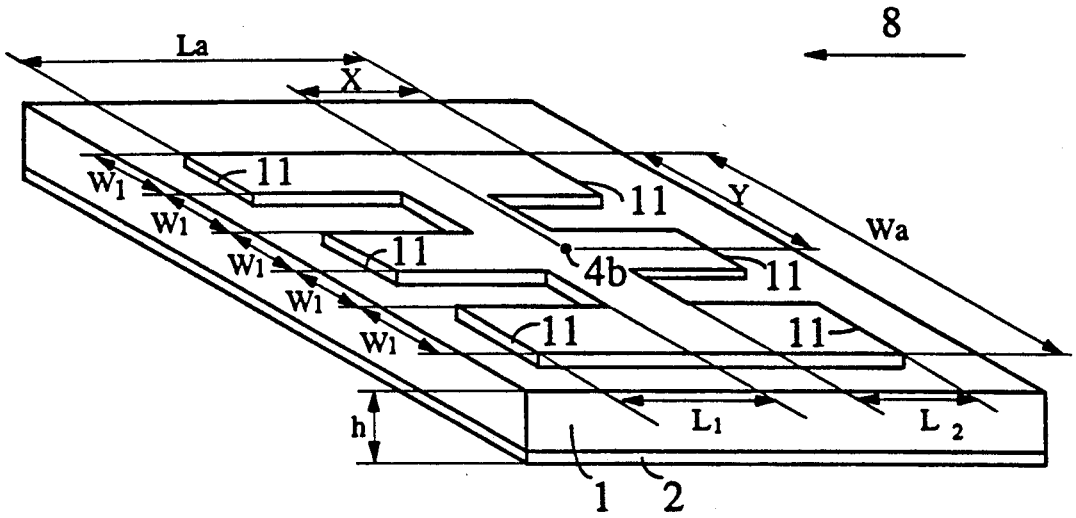
FIG. 2 is a perspective view of a comb-shaped low frequency band microstrip antenna.
Figure 4:
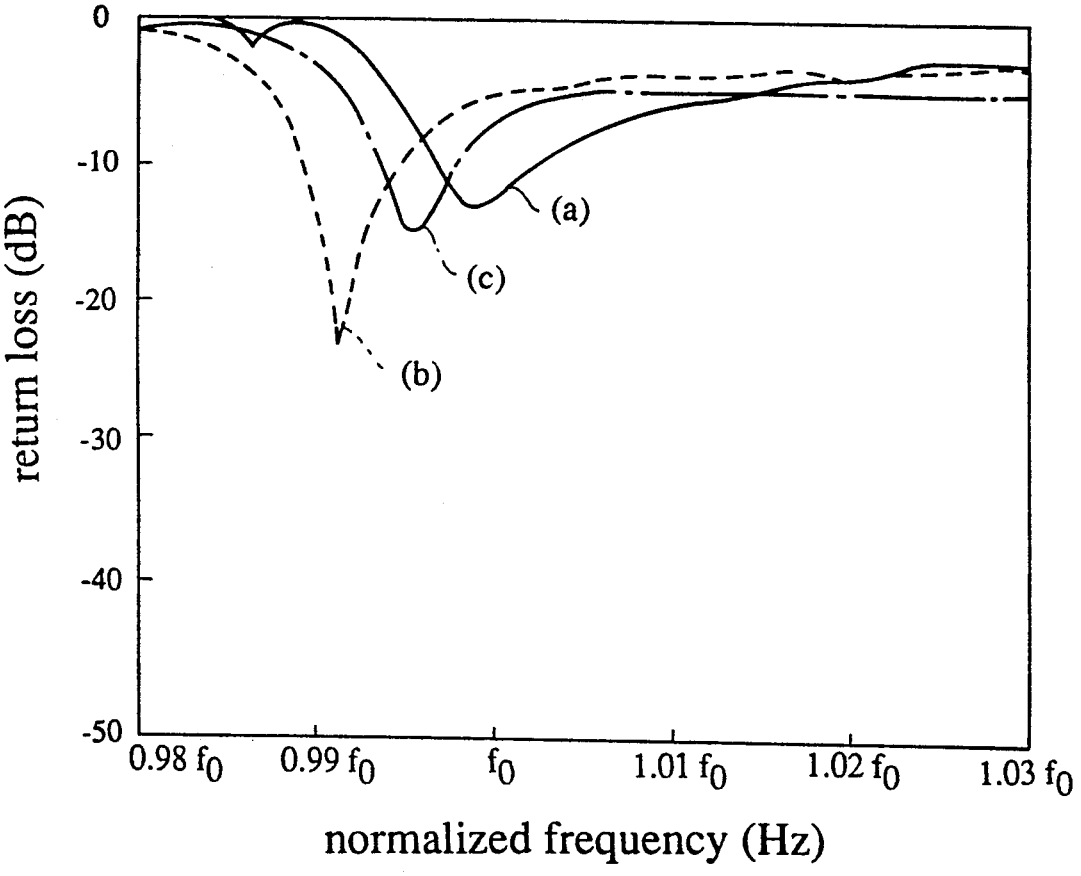
FIG. 4 shows reflection characteristics of a high frequency band microstrip antenna disposed on the lower layer.

FIG. 2 is a perspective view of a comb-shaped low frequency band radiating conductor 7. The operation principle of the comb-shaped microstrip antenna is like that of the conventional rectangular microstrip antenna. The resonance frequency f0 of the fundamental mode of the comb-shaped microstrip antenna is mainly determined by the edge length L of the radiating conductor 3 and the relative dielectric constant $\epsilon r$ of the dielectric substrate 1*a*. The frequency band width of the comb-shaped microstrip antenna is also determined by the relative dielectric constant $\epsilon r$ and the thickness h of the dielectric substrate 1*a*. The frequency band width of the comb-shaped microstrip antenna is about several percents as shown in FIG. 4.

An impedance at the power supply points of the power supplying through-hole 4*a* which supply the microwave energy to the comb-shaped radiating conductor becomes high when the power supplying through-hole 4*a* is adjacent at the position of the open border edge so that the distance X equals 0. The impedance at the power supply points becomes lower when the power supplying through-hole 4*a* reaches a center of the radiating conductor 3. Therefore, the impedance at the power supply points is matched by selecting the distance X.

The dimension Y of the comb-shaped radiating conductor 7 is selected such as $Y=W_a/2$ in order to avoid the generation of the cross polarized wave component.

The comb depth L1, L2 and the space W1 of the comb-shaped radiating conductor 7 are experimentally determined so that the comb gaps allows the electromagnetic wave radiated from the high frequency band microstrip antenna to be radiated therethrough to space.

The shape of the low frequency band radiating conductor 7 disposed on the upper layer is determined so that the electromagnetic wave radiated from the high frequency band microstrip antenna is less influenced by blocking. The shape of the low frequency band radiating conductor is also determined experimentally by the relation between the position of the high frequency band radiating conductor 3 disposed on the lower layer and the position of the low frequency band radiating conductor 7 disposed on the upper layer which influence each other.

Figure 3:
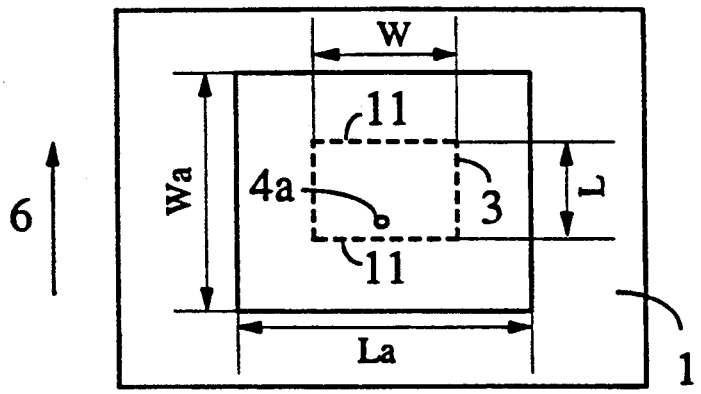
FIGS. 3*a*, 3*b* and 3*c* show three kinds of arrangements in which the low frequency band radiating conductor disposed on the upper layer and the high frequency band radiating conductor disposed on the lower layer have the same rectangular shape.
Figure 3:
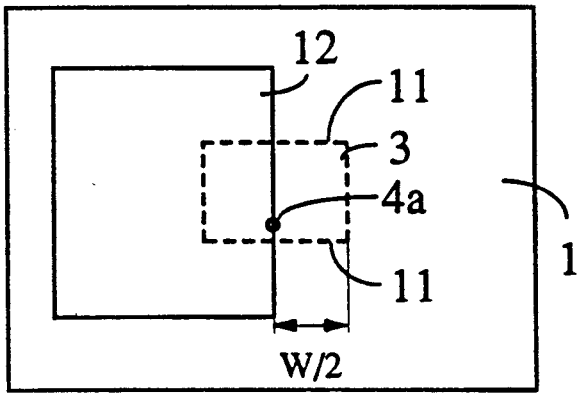
Figure 3:
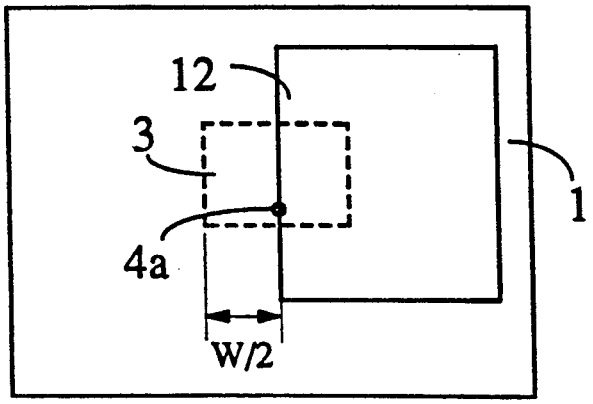

FIGS. 3*a*, 3*b*, and 3*c* show three kinds of arrangements in case the shape of the low frequency band radiating conductor 12 disposed on the upper layer is the same rectangular shape as that of the high frequency band radiating conductor 3 disposed on the lower layer. FIG. 3(*a*), (*b*) and (*c*) show the states in which each low frequency band radiating conductor 12 disposed on the upper layer is shifted from the high frequency band radiating conductor 3 disposed on the lower layer.

FIG. 4 shows reflection characteristics of the high frequency band microstrip antenna disposed on the lower layer corresponding to FIGS. 3*a*, 3*b*, and 3*c*. When the blocking rectangular low frequency band radiating conductor 12 is disposed at the upper layer, the return loss becomes poor such as about −13 dB∼−4 dB at the designed normalized center frequency f0. It is easily understood that the electromagnetic wave radiated from the high frequency band microstrip antenna on the lower layer cannot radiate sufficiently into space.

Figure 5:
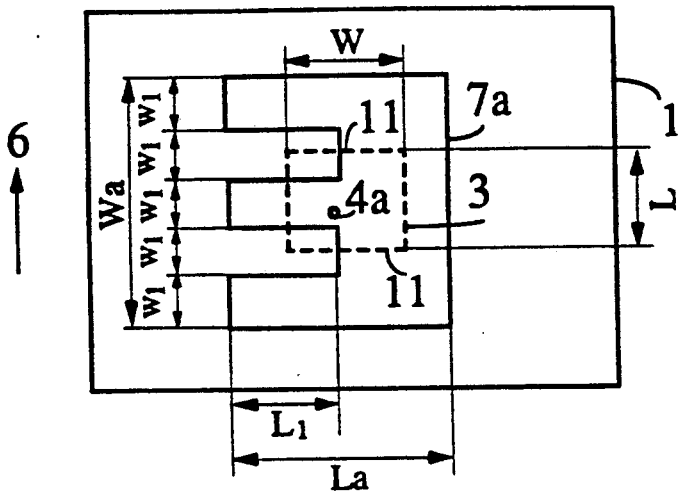
Figure 5:
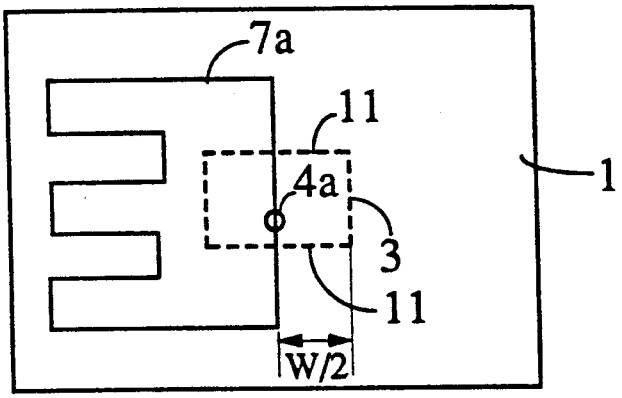
Figure 5:
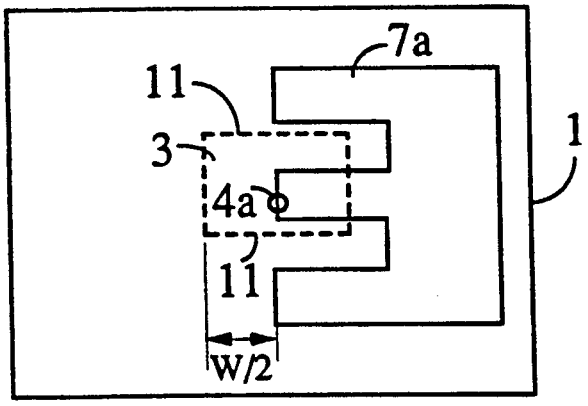

FIGS. 5*a*, 5*b*, and 5*c* show three kinds of arrangements in case the low frequency band radiating conductor 7*a* has a comb-shape only at one side of it on the upper layer. FIG. 5(*a*), (*b*) and (*c*) show the states in which each low frequency band radiating conductor 7*a* disposed on the upper layer is shifted from the high frequency band radiating conductor 3 disposed on the lower layer. In the comb-shape, the length L1 and the length L2 is obtained such as L1=La/2, and the comb width W1 is obtained by equally dividing the width W of the low frequency band radiating conductor by five.

Figure 6:
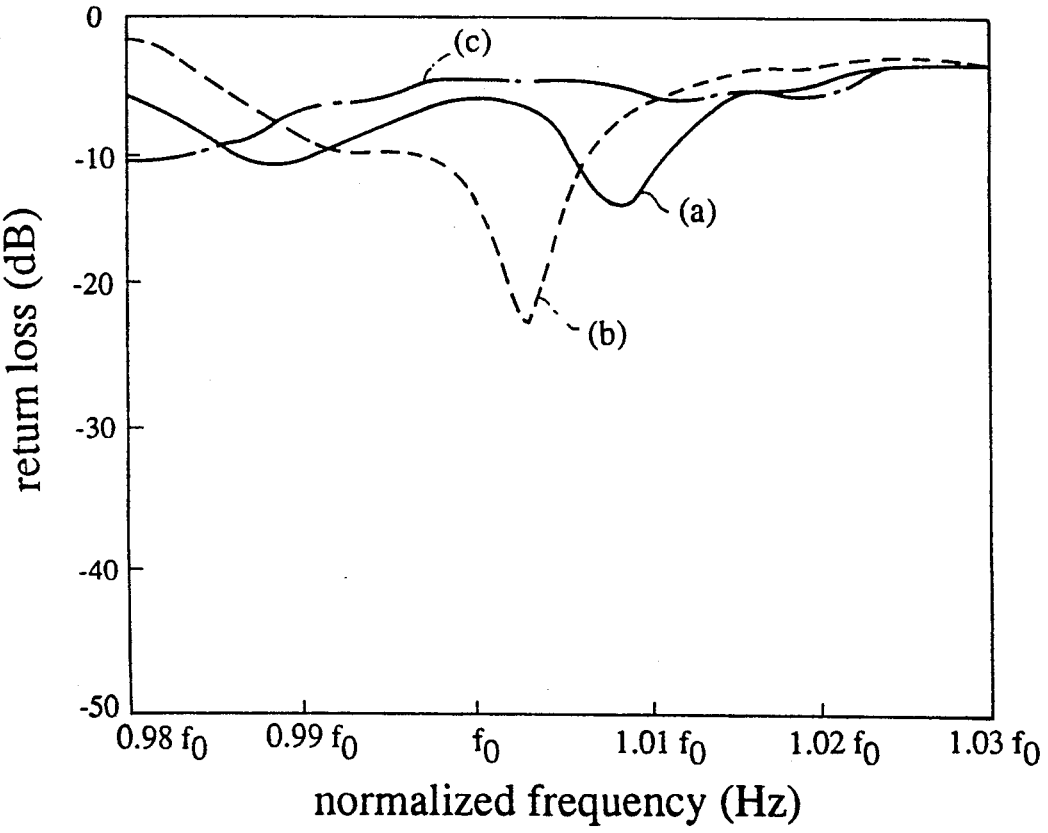
FIG. 6 shows reflection characteristics of the high frequency band microstrip antenna disposed on the lower layer corresponding to FIG. 5.

FIG. 6 shows reflection characteristics of the high frequency band microstrip antenna disposed on the lower layer corresponding to FIG. 5. When the blocking rectangular low frequency band radiating conductor 7*a*, having a comb shape at one side of it, is disposed at the upper layer, the return loss becomes poor such as about −14 dB∼−4 dB at the designed normalized center frequency f0. Accordingly, it is easily understood that the electromagnetic wave radiated from the high frequency band microstrip antenna on the lower layer cannot radiate sufficiently into space.

Figure 7:
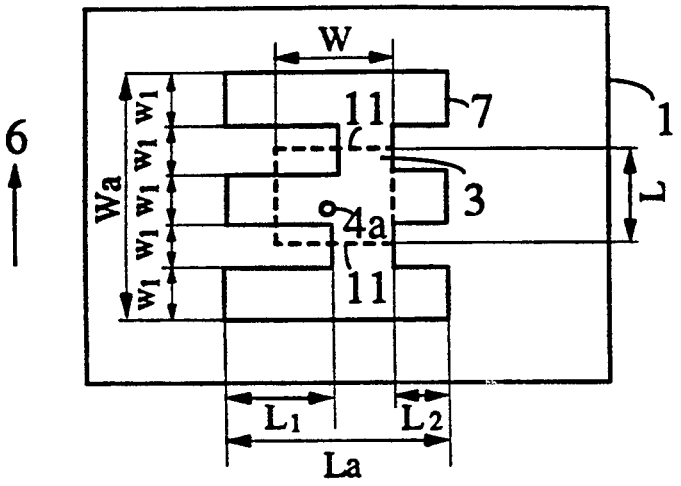
Figure 7:
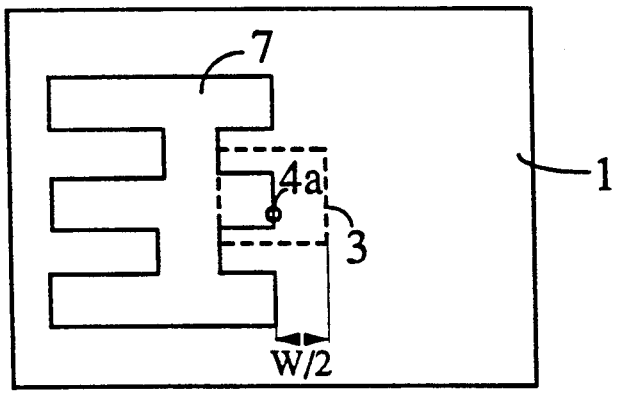
Figure 7:
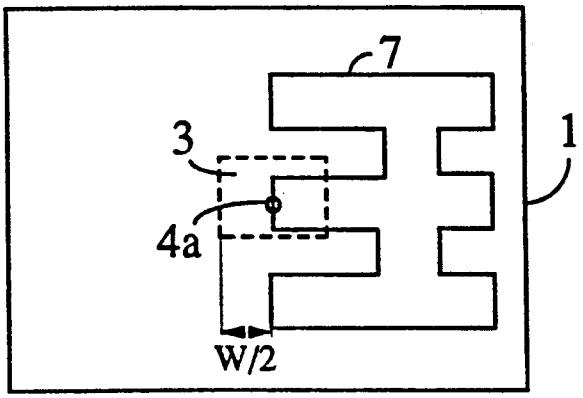

FIGS. 7*a*, 7*b*, and 7*c* show three kinds of arrangements in case the low frequency band radiating conductor 7 has a comb-shape at both sides of it on the upper layer. FIG. 7(*a*), (*b*) and (*c*) show the states in which each low frequency band radiating conductor 7 disposed on the upper layer is shifted from the high frequency band radiating conductor 3 disposed on the lower layer. In the comb-shape, the length L1 and the length L2 is obtained such as L1=La/2, L2=La/4 and the comb width W1 is obtained by equally dividing the width Wa of the low frequency band radiating conductor 7 by five.

Figure 8:
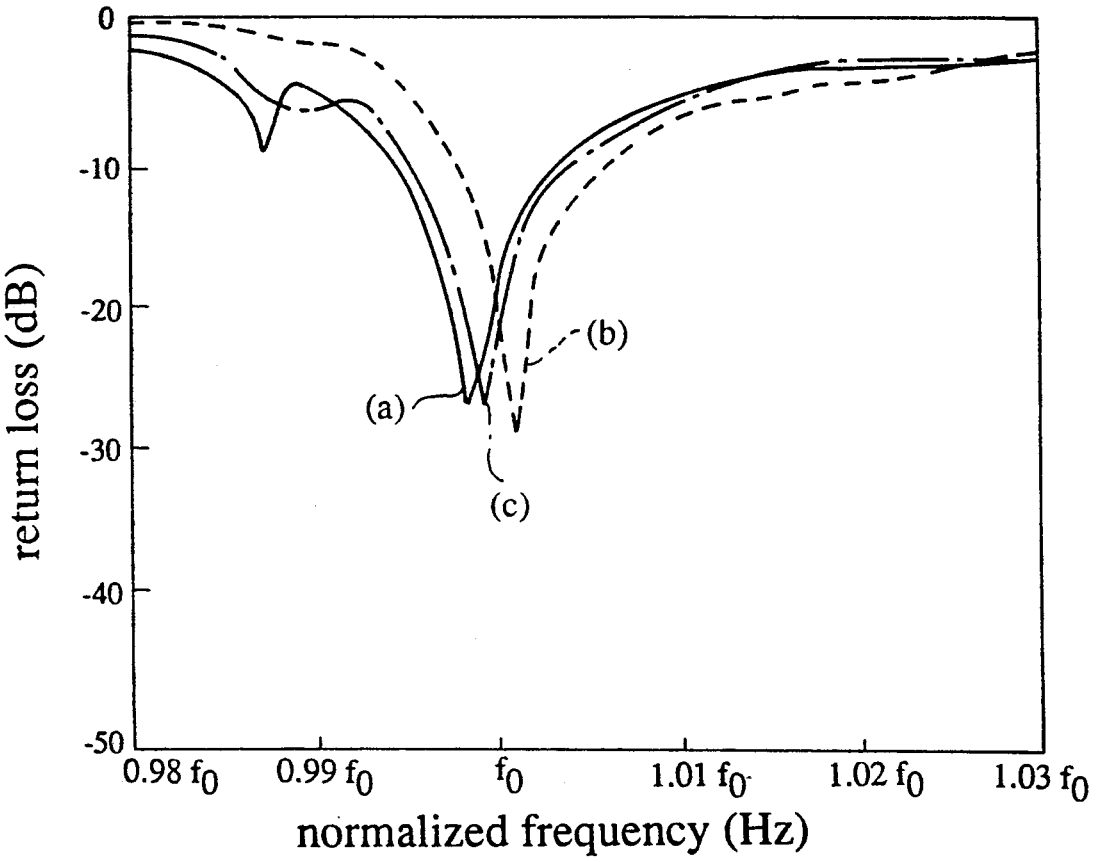
FIG. 8 shows reflection characteristics of the high frequency band microstrip antenna disposed on the lower layer corresponding to FIG. 7.

FIG. 8 shows reflection characteristics of the high frequency band radiating conductor 3 disposed on the lower layer corresponding to FIG. 7. When the blocking rectangular low frequency band microstrip antenna 7, having a comb-shape at both sides of it, is disposed at the upper layer, the return loss is good such as lower than about −20 dB at the designed normalized center frequency f0, even if the low frequency band radiating conductor 7 is shifted such as (*b*) and (*c*) against the high frequency band radiating conductor 3. Accordingly, it is easily understood that the electromagnetic wave radiated from the high frequency band microstrip antenna on the lower layer is radiated sufficiently into space.

In the above embodiment, the low frequency band radiating conductor 7 has three comb pieces at both sides of it. But, the shape of the low frequency band radiating conductor 7 can be formed using five comb pieces or seven comb pieces by dividing the width Wa of the low frequency band radiating conductor 7 by seven or nine (devisor), respectively, without changing the ratio of L1 and L2. In general, the come piece number m is obtained m−(2n−1), where n is a divisor. In these cases, the reflection characteristics of the high frequency band radiating conductor 3 is substantially the same as that having three comb pieces.

The operation of the array antenna at a high frequency band is explained here. For example, when the Ku band microwave inputs into the power supplying through-hole 4*a* on the earth conductor 2*a*, and is supplied to the high frequency band radiating conductor 3 on the dielectric substrate 1*a*, a current component being parallel to the high frequency band polarization direction 6 or a magnetic current component orthogonal to the low frequency band polarization direction 6 are generated on the high frequency band radiating conductor 3 or thereabout. An electromagnetic wave is radiated from the high frequency band microstrip antenna 3 to the space by the current sources and the magnetic current sources which are formed of the current components and the magnetic current components, respectively. The electric field direction of the radiated electromagnetic wave is the same as the high frequency band polarization direction 6. Since the Ku band region of the electromagnetic wave radiated from the current source or the magnetic current source is far apart from the resonance frequency of the comb-shaped low frequency band microstrip antenna and since the high frequency band polarization direction 6 is perpendicular to the high frequency band polarization direction 8 of the comb-shaped low frequency band microstrip antenna, the Ku band electromagnetic wave is hardly influenced by the low frequency band microstrip antenna. By forming the low frequency band radiating conductor 7 into a comb-shape, the electromagnetic wave radiated from the high frequency band microstrip antenna is radiated through the comb gap of the low frequency band radiating conductor 7 without substantially being blocked by the low frequency band microstrip antenna 7.

Figure 9:
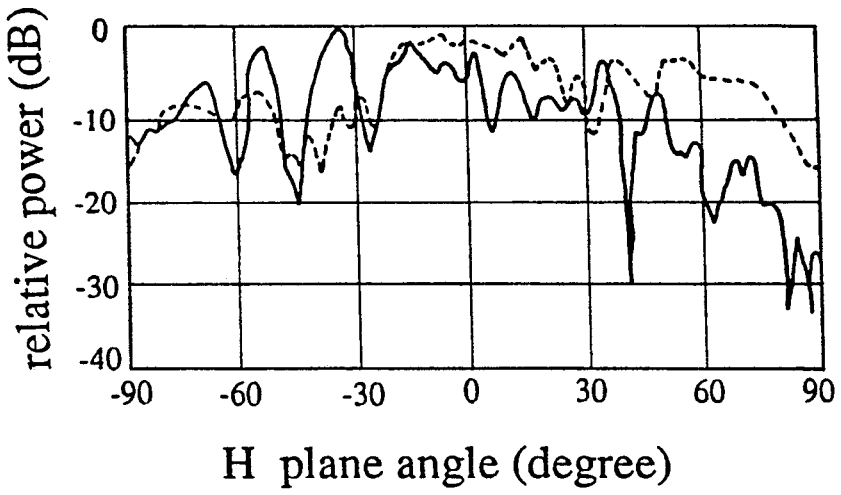
FIGS. 9*a* and 9*b* shows radiation characteristics of the electromagnetic wave radiated from the high frequency band microstrip antenna shown in FIG. 3(*a*).
Figure 9:
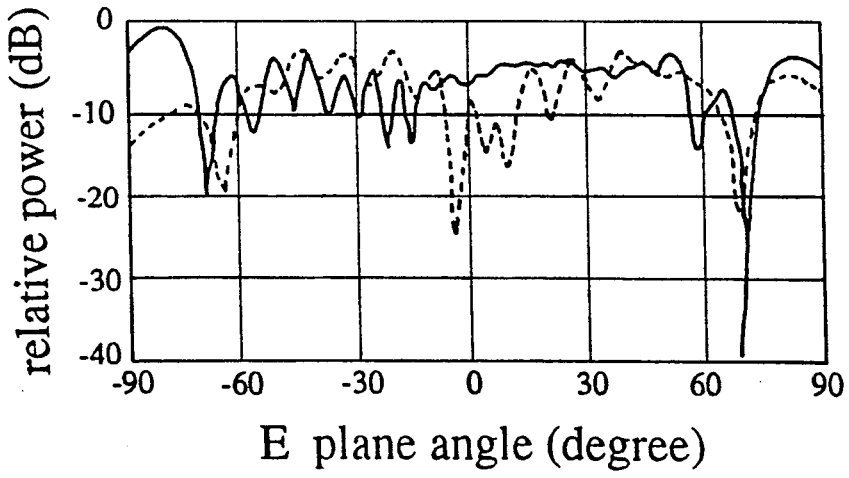

FIGS. 9*a* and 9*b* show radiation characteristics of the electromagnetic wave radiated from the high frequency band microstrip antenna shown in FIG. 3(*a*). FIG. 9(*a*) shows H plane radiation characteristics radiated from the high frequency band microstrip antenna. FIG. 9(*b*) shows E plane radiation characteristics radiated from the high frequency band microstrip antenna. In the figures, the solid lines show a co-polarized wave and the dotted lines show a cross polarized wave. There are no apparent differences between the relative powers of the co-polarized wave and the cross polarized wave. Accordingly, it is well understood that the electromagnetic wave radiated from the high frequency band microstrip antenna is prevented by the rectangular-shaped low frequency band microstrip antenna and can not be radiated sufficiently into space.

Figure 10:
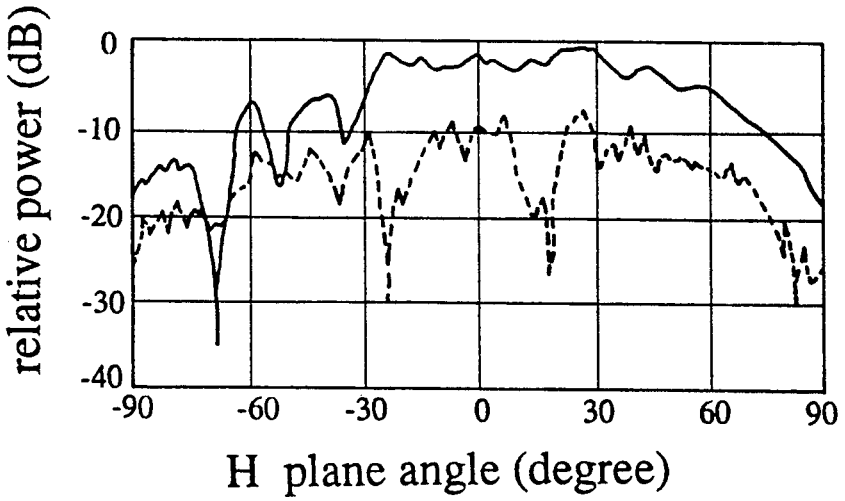
FIGS. 10*a* and 10*b* show a radiation characteristics of the electromagnetic wave radiated from the high frequency band microstrip antenna 3 shown in FIG. 7(*a*).
Figure 10:
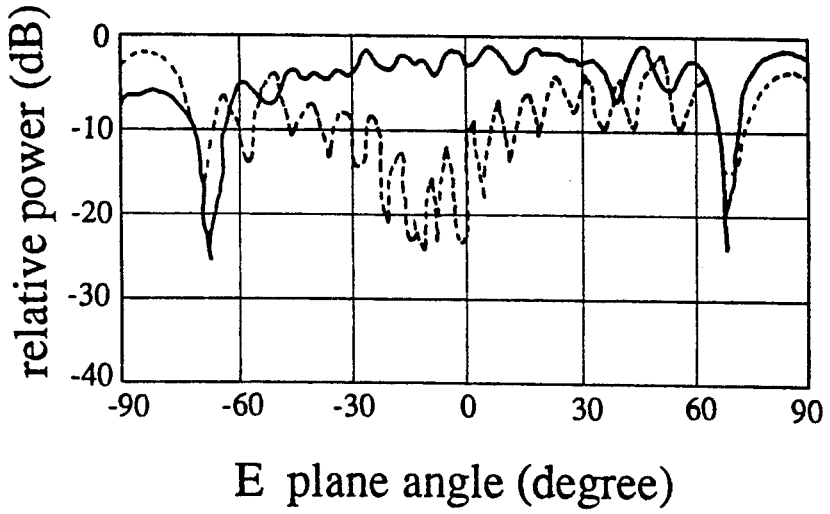

FIG. 10 shows radiation characteristics of the electromagnetic wave radiated from the high frequency band microstrip antenna shown in FIG. 7(*a*). FIG. 10(*a*) shows H plane radiation characteristics radiated from the high frequency band microstrip antenna. FIG. 10(*b*) shows E plane radiation characteristics radiated from the high frequency band microstrip antenna. In the figures, the solid lines show co-polarized waves and the dotted lines show cross polarized waves. There are apparent differences between the relative powers of the positive polarized wave and the cross polarized wave. Accordingly, it is easily understood that the electromagnetic wave radiated from the high frequency band microstrip antenna is not prevented by the comb-shaped low frequency band microstrip antenna 7 and can be radiated sufficiently into space.

Second Embodiment

Figure 11:
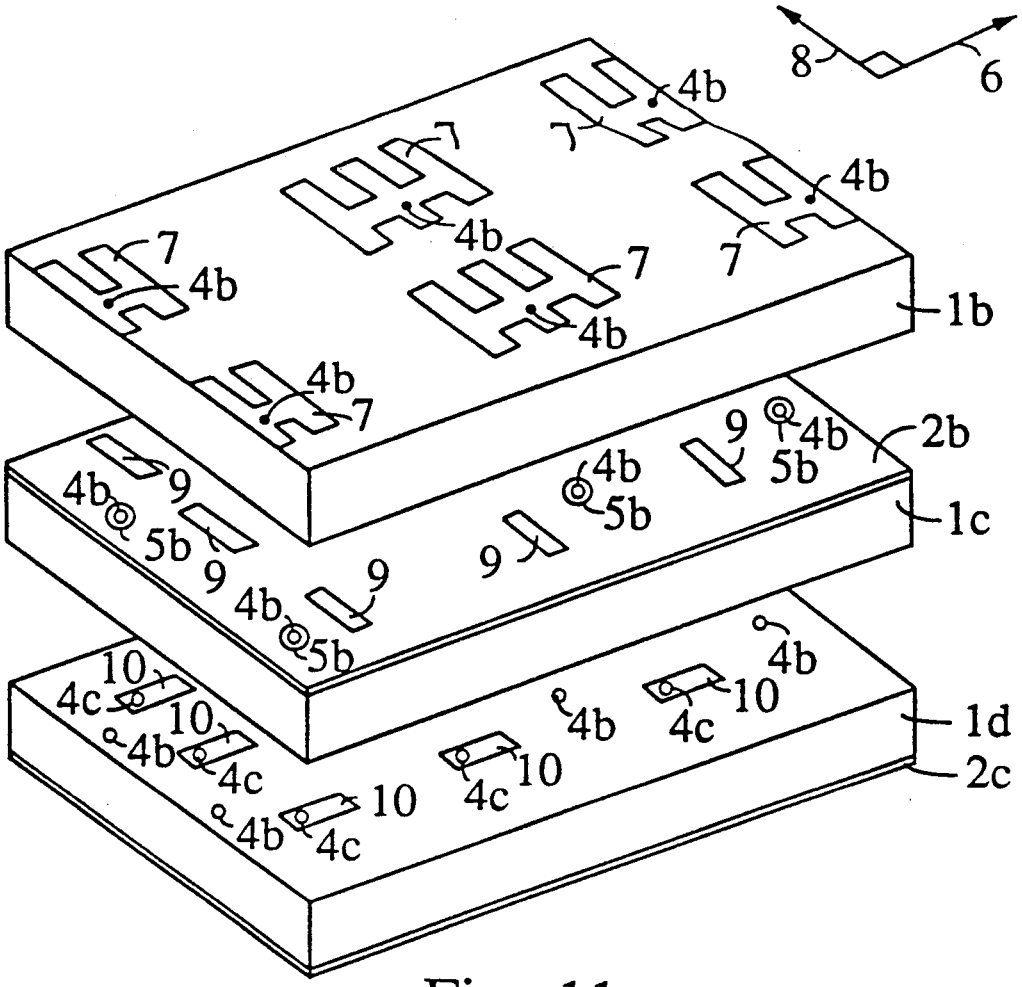
FIGS. 11*a* and 11*b* are perspective view of a part of a multi layer array antenna of a second embodiment of the present invention.
Figure 11:
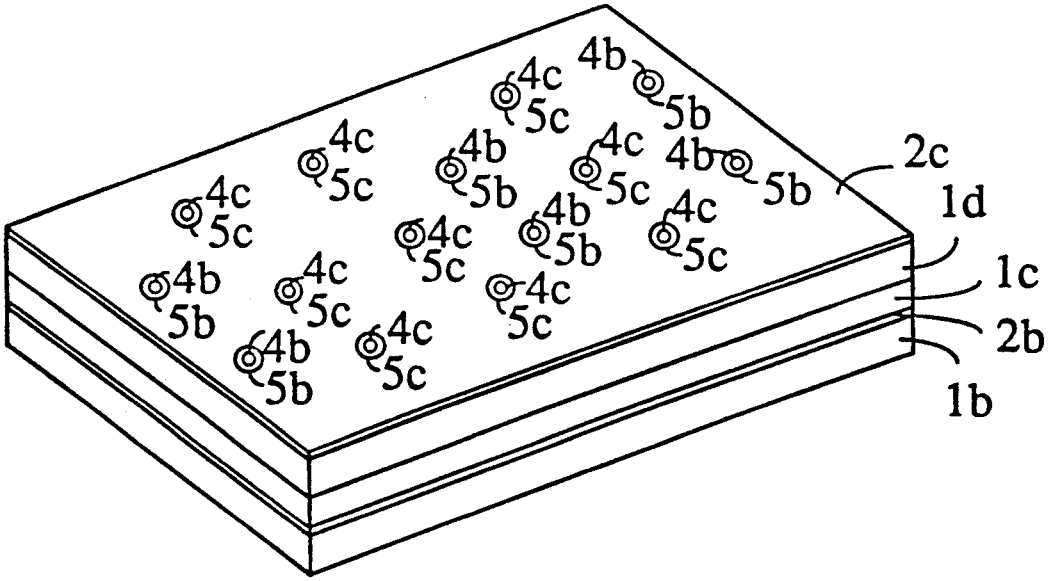
Figure 13:
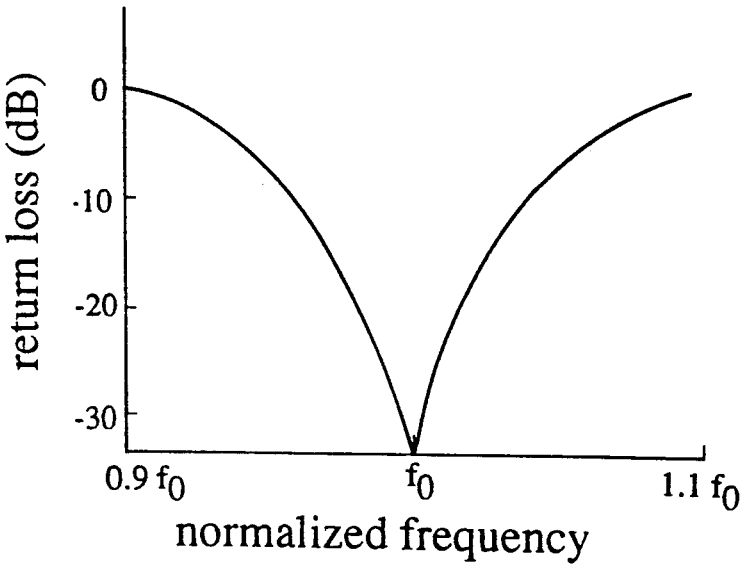
FIG. 13 shows a relation between frequency and reflection characteristics of the microstrip antenna used as the conventional array antenna.

FIGS. 11*a* and 11*b* are perspective view of a part of a multi layer array antenna of a second embodiment of the present invention. FIG. 11(*a*) is perspective view of the multi layer array antenna as viewed from the top face. FIG. 11(*b*) is perspective view of the multi layer array antenna as viewed from the bottom face. In the figures, 1*d*, 1*c*, 1*b* are dielectric substrates. 9 is a plurality of high frequency band slot elements which are formed on the substrate 1*c*. 10 is a plurality of coupling striplines on the dielectric substrate 1*d*, which have the function of supplying the microwave energy to the plurality of high frequency band slot elements 9. 4*c* are power supplying through-holes and 5*c* are clearances, which supply the microwave energy to the coupling strip lines 10.

The operation of the second embodiment is explained here. In the explanation, the operating frequency is referred to two frequency bands, a low frequency band and a high frequency band.

The operation of the array antenna at low frequency band is explained here. For example, when the X band microwave inputs into the power supplying through-holes 4*c* on the earth conductor 2*c*, and is supplied to the comb-shaped low frequency band microstrip antenna 7 on the dielectric substrate 1*b* through the dielectric substrate 1*c*, a current component being parallel to the low frequency band polarization direction 8 or a magnetic current component orthogonal to the low frequency band polarization direction 8 are generated on the comb-shaped low frequency band radiating antenna 7 or thereabout. An electromagnetic wave is radiated from the comb-shaped low frequency band microstrip antenna to space by the current sources and the magnetic current sources which are formed by the current components and the magnetic current components, respectively. The electric field direction of the radiated electromagnetic wave is the same as the low frequency band polarization direction 8. Since the X band region of the electromagnetic wave radiated from the current source or the magnetic current source is far apart from the resonance frequency of the high frequency band slot antenna, and since the low frequency band polarization direction 8 is perpendicular to the high frequency band polarization direction 6, the X band electromagnetic wave is hardly influenced by the high frequency band slot antenna.

The characteristics of the comb-shaped low frequency band microstrip antenna is substantially the same as that of the first embodiment.

The operation of the array antenna at high frequency band is explained here. For example, Ku band microwave inputs into the power supplying through-hole 4*c* on the earth conductor 2*c*, then the Ku band microwave energy is supplied to the high frequency band coupling strip line 10 on the dielectric substrate 1*d*, and excites the high frequency band slot element 9 by electromagnetic coupling. A current component being parallel to the high frequency band polarization direction 6 or a magnetic current component orthogonal to the low frequency band polarization direction 6 is generated on the high frequency band slot antenna 9. An electromagnetic wave is radiated from the high frequency band slot element to space through the dielectric substrate 1*b* by the current sources and the magnetic current sources which are formed by the current components and the magnetic current components, respectively. Since the high frequency band polarization direction 6 is perpendicular to the low frequency band polarization direction 8 of the comb-shaped low frequency band microstrip antenna, the Ku band electromagnetic wave is hardly influenced by the low frequency band microstrip antenna. By forming the low frequency band radiating conductor 7 into a comb-shape, the electromagnetic wave radiated from the high frequency band slot antenna 9 is radiated through the comb gaps of the low frequency band radiating conductor 7 without being substantially blocked by the low frequency band microstrip antenna 7.

What is claimed is:

1. A multi-layer array antenna comprising a plurality of rectangular radiating conductors on a first surface of a first dielectric substrate, an earth conductor on a second surface parallel to and opposite the first surface of the first dielectric substrate, the antenna characterized by comprising:

the plurality of rectangular radiating conductors arranged in an array to form a high frequency band microstrip antenna;

a plurality of comb-shaped radiating conductors arranged in an array to form a low frequency band microstrip antenna formed on a surface of a second dielectric substrate which is disposed on the first dielectric substrate;

through-holes for supplying microwave power to the comb-shaped radiating conductors of the low frequency band microstrip antenna through the first and second dielectric substrates;

through-holes for supplying microwave power to the rectangular radiating conductors of the high frequency band microstrip antenna through the first dielectric substrate; and the earth conductor which is a ground plane for both the low frequency and high frequency band microstrip antennas.

2. In the multi-layer antenna array, as claimed in claim 1, wherein the high frequency band microstrip antenna array is constructed and arranged so as to operate at Ku-Band.

3. In the multi-layer antenna array, as claimed in claim 1, wherein the low frequency band microstrip antenna array is constructed and arranged so as to operate at X-Band.

4. In the multi-layer antenna array, as claimed in claim 3, wherein the high frequency band microstrip antenna array is constructed and arranged so as to operate at Ku-Band.

5. In the multi-layer antenna array, as claimed in claim 1, wherein the low frequency band comb-shaped microstrip antenna radiating conductor is constructed and arranged so as to operate at polarization perpendicular to a polarization of the high frequency rectangular radiating conductor and to be transparent to signals transmitted and/or received by the high frequency antenna array.

6. In the multi-layer antenna array, as claimed in claim 5, wherein the comb-shaped radiating conductor includes a transmission line of length Wa having first and second sides, the first side having three equal-dimensioned stub elements protruding therefrom, and the second side having three equal-dimensioned stub elements protruding therefrom.

7. In the multi-layer antenna array, as claimed in claim 6, wherein the first and second dielectric substrates include clearances for preventing direct current from flowing through the through-holes in the first and second dielectric substrates, from a power source, to the earth conductor.

8. In the multi-layer antenna array, as claimed in claim 6, wherein the length of the equal-dimensioned stubs protruding from the first side of the transmission line is on-half of an edge length La, the length of the equal-dimensioned stubs protruding from the second side of the transmission line is one-fourth the edge length La, and the width of the stubs protruding from both sides of the transmission line is one-fifth of the transmission line length Wa.

9. In the multi-layer antenna array, as claimed in claim 5, wherein the comb-shaped radiating conductor includes a transmission line of length Wa having first and second sides, the first side having five equal-dimensioned stub elements protruding therefrom, and the second side having five equal-dimensioned stub elements protruding therefrom.

10. In the multi-layer antenna array, as claimed in claim 9, wherein the length of the equal-dimensioned stubs protruding from the first side of the transmission line is one-half of an edge length La, the length of the equal-dimensioned stubs protruding from the second side of the transmission line is one-fourth the edge length La, and the width of the stubs protruding from both sides of the transmission line is one-seventh of the transmission line length Wa.

11. In the multi-layer antenna array, as claimed in claim 5, wherein the comb-shaped radiating conductor includes a transmission line of length Wa having first and second sides, the first side having seven equal-dimensioned stub elements protruding therefrom, and the second side having seven equal-dimensioned stub elements protruding therefrom.

12. In the multi-layer antenna array, as claimed in claim 11, wherein the length of the equal-dimensioned stubs protruding from the first side of the transmission line is one-half of an edge length La, the length of the equal-dimensioned stubs protruding from the second side of the transmission line is one-fourth the edge length La, and the width of the stubs protruding from both sides of the transmission line is one-ninth of the transmission line length Wa.

13. A multi-layer array antenna comprising a plurality of conductors on a first surface of a first dielectric substrate, an earth conductor on a second surface parallel to and opposite the first surface of the first dielectric substrate, the antenna characterized by comprising:

the plurality of conductors arranged in an array of coupling striplines for supplying microwave power to an array of high frequency band radiating slot elements;

the plurality of radiating slot elements, formed through a second dielectric substrate which is disposed on the first dielectric substrate, arranged in an array to form a high frequency band slot antenna;

a plurality of comb-shaped radiating conductors arranged in an array to form a low frequency band microstrip antenna formed on a surface of a third dielectric substrate which is disposed on the second dielectric substrate;

through-holes for supplying microwave power to the comb-shaped radiating conductors of the low frequency band microstrip antenna through the first, second and third dielectric substrates;

through-holes for supplying microwave power to the coupling striplines through the first dielectric substrate;

the earth conductor which operates as a ground plane for the high frequency band slot antenna; and a second earth conductor on a top surface of the second dielectric substrate which operates as a ground plane for the low frequency band microstrip antenna.

14. In the multi-layer antenna array, as claimed in claim 13, wherein the high frequency band slot antenna array is constructed and arranged so as to operate at Ku-Band.

15. In the multi-layer antenna array, as claimed in claim 13, wherein the low frequency band microstrip antenna array is constructed and arranged so as to operate at X-Band.

16. In the multi-layer antenna array, as claimed in claim 15, wherein the high frequency band antenna array is constructed and arranged so as to operate at Ku-Band.

17. In the multi-layer antenna array, as claimed in claim 13, wherein the low frequency band comb-shaped microstrip radiating conductor is constructed and arranged so as to operate at polarization perpendicular to a polarization of the high frequency slot element and to be transparent to signals transmitted and/or received by the high frequency antenna array.

18. In the multi-layer antenna array, as claimed in claim 17, wherein the comb-shaped radiating conductor includes a transmission line of length Wa having first and second sides, the first side having three equal-dimensioned stub elements protruding therefrom, and the second side having three equal-dimensioned stub elements protruding therefrom.

19. In the multi-layer antenna array, as claimed in claim 18, wherein the length of the equal-dimensioned stubs protruding from the first side of the transmission line is one-half of an edge length La, the length of the equal-dimensioned stubs protruding from the second side of the transmission line is one-fourth the edge length La, and the width of the stubs protruding from both sides of the transmission line is one-fifth of the transmission line length Wa.

20. In the multi-layer antenna array, as claimed in claim 17, wherein the comb-shaped radiating conductor includes a transmission line of length Wa having first and second sides, the first side having five equal-dimensioned stub elements protruding therefrom, and the second side having five equal-dimensioned stub elements protruding therefrom.

21. In the multi-layer antenna array, as claimed in claim 20, wherein the length of the equal-dimensioned stubs protruding from the first side of the transmission line is one-half of an edge length La, the length of the equal-dimensioned stubs protruding from the second side of the transmission line is one-fourth the edge length La, and the width of the stubs protruding from both sides of the transmission line is one-seventh of the transmission line length Wa.

22. In the multi-layer antenna array, as claimed in claim 17, wherein the comb-shaped radiating conductor includes a transmission line of length Wa having first and second sides, the first side having seven equal-dimensioned stub elements protruding therefrom, and the second side having seven equal-dimensioned stub elements protruding therefrom.

23. In the multi-layer antenna array, as claimed in claim 22, wherein the length of the equal-dimensioned stubs protruding from the first side of the transmission line is one-half of an edge length La, the length of the equal-dimensioned stubs protruding from the second side of the transmission line is one-fourth the edge length La, and the width of the stubs protruding from both sides of the transmission line is one-ninth of the transmission line length Wa.

24. In the multi-layer antenna array, as claimed in claim 13, wherein the first, second, and third dielectric substrates include clearances for preventing direct current from flowing through the through-holes in the first, second, and third dielectric substrates from a power source to the earth conductor.

* * * * *